US006173537B1

(12) United States Patent
Davidsson et al.

(10) Patent No.: US 6,173,537 B1
(45) **Date of Patent: *Jan. 16, 2001**

(54) ANTENNA TOWER

(75) Inventors: Mikael Davidsson, Färnäs (SE); Heikki Miettinen, Lohja (FI)

(73) Assignees: Mafi AB, Mora (SE); Transmast LTD, Degergy (FI)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/652,596

(22) PCT Filed: Dec. 12, 1994

(86) PCT No.: PCT/SE94/01194

§ 371 Date: Jun. 13, 1996

§ 102(e) Date: Jun. 13, 1996

(87) PCT Pub. No.: WO95/16840

PCT Pub. Date: Jun. 22, 1995

(30) Foreign Application Priority Data

Dec. 15, 1993 (SE) ..... 9304181

(51) Int. Cl.[7] ..... E04H 12/08; H01Q 1/42

(52) U.S. Cl. ..... 52/40; 52/726.4; 52/736.1; 52/737.6; 52/732.3; 343/890

(58) Field of Search ..... 343/890, 891, 343/878; 454/237, 251, 184; 52/40, 726.1, 726.3, 726.4, 736.1, 737.4, 737.6, 738.1, 736.2, 732.3, 651.01, 651.02, 651.04, 651.07

(56) References Cited

U.S. PATENT DOCUMENTS

| | | | | |
|---|---|---|---|---|
| 126,356 | * | 4/1872 | Ward | 307/149 |
| 945,475 | * | 1/1910 | Pfund | 343/890 X |
| 1,162,657 | * | 11/1915 | Schweitzer | 52/40 X |
| 1,870,770 | * | 8/1932 | De Witt | 52/726.4 |
| 2,066,419 | * | 1/1937 | Pfistershammer | 52/736.2 |
| 3,045,783 | * | 7/1962 | Daniels | 52/736.2 X |
| 3,217,459 | * | 11/1965 | Meyer | 52/726.4 X |
| 3,325,950 | * | 6/1967 | Pfaff, Jr. | 52/736.2 X |
| 3,571,991 | * | 3/1971 | Doocy et al. | 52/651.02 X |
| 3,686,498 | * | 8/1972 | Meyer | 52/40 |
| 3,768,016 | * | 10/1973 | Townsend et al. | 343/891 X |
| 4,899,500 | * | 2/1990 | Miller et al. | 52/726.4 X |
| 5,162,807 | * | 11/1992 | Ursenbach et al. | 343/890 X |
| 5,175,971 | * | 1/1993 | McCombs | 52/726.4 X |
| 5,200,759 | * | 4/1993 | McGinnis | 343/890 |
| 5,333,436 | * | 8/1994 | Moble | 52/726.1 X |
| 5,581,958 | * | 12/1996 | Cote | 52/40 |
| 5,611,176 | * | 3/1997 | Juengert et al. | 52/40 |

FOREIGN PATENT DOCUMENTS

| | | | | |
|---|---|---|---|---|
| 2910056 | * | 9/1980 | (DE) | 343/891 |
| 2935618 | | 3/1981 | (DE) . | |
| 586007 | * | 3/1947 | (GB) | 52/726.3 |
| 333959 | | 4/1971 | (SE) . | |
| 443015 | | 2/1986 | (SE) . | |

OTHER PUBLICATIONS

Nishida, "Design concepts of aesthetic EHV transmission poles", Sumimoto Search No. 15, pp. 108–124, May 1976.*

* cited by examiner

*Primary Examiner*—Laura A. Callo
(74) *Attorney, Agent, or Firm*—Henderson & Sturm LLP

(57) ABSTRACT

The invention relates to a tower (1) serving as an antenna carrier and having a space (3) for electronic equipment, such as radio equipment, provided in connection therewith, whereby the tower (1) is formed of a number of interconnectable, generally ring-shaped sections (2, 2*a*, 3, 3*a*) of which a lower section (3) forms an electronic equipment integrated in the tower (1).

12 Claims, 2 Drawing Sheets

Fig. 3
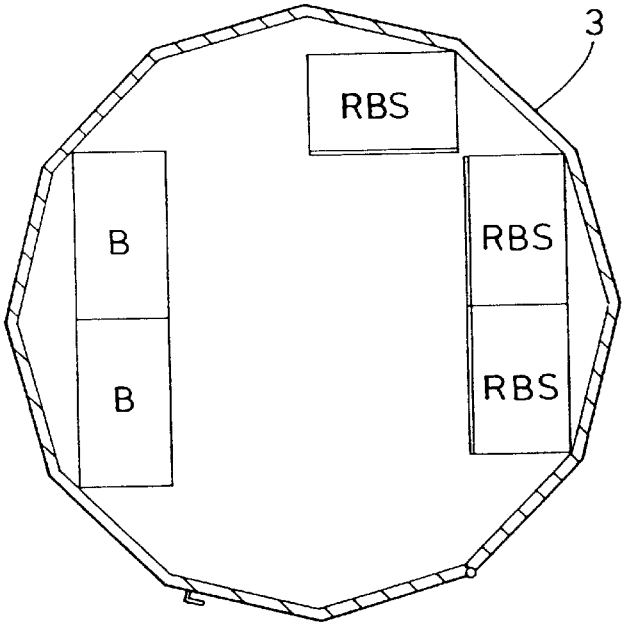
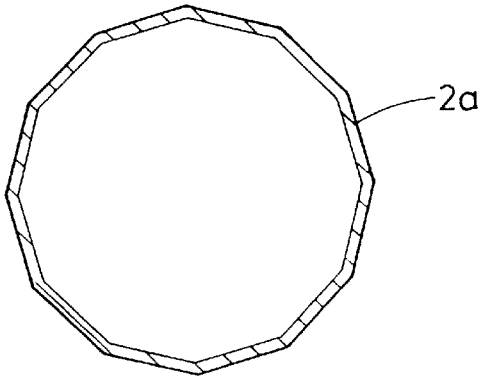
Fig. 2
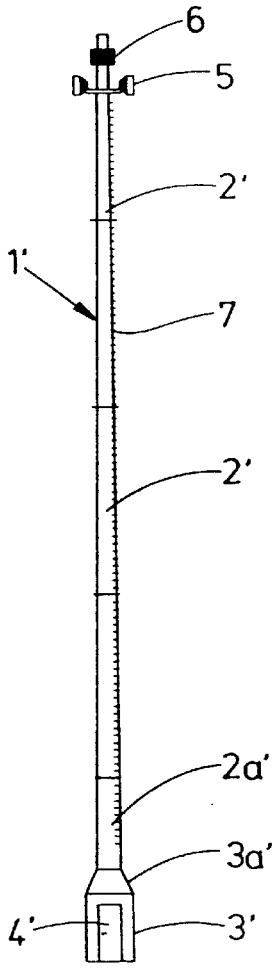
Fig. 4

ANTENNA TOWER

This invention relates to a tower intended to serve as an antenna carrier.

Traditionally masts employed as antenna carriers within radio-, data- and telecommunication have been of the lattice type which in addition to being well tested has the advantage that its surface exposed to wind is comparatively small and that it may therefore be built having a considerable height. The traditional lattice type masts do however suffer from several disadvantages. Among these may be mentioned that the lattice type masts are relatively exposed when it comes to danger of sabotage, since the cables run comparatively unprotected in the masts and especially at their passage to the required electronic equipment, such as radio equipment, for which a separate building or container must be provided, which is either isolated at the side of the mast or on which the mast is erected. Furthermore, expensive and energy consuming air-conditioning plants are almost always required in order to maintain the electronic equipment at an acceptable temperature, that is usually at a maximum of 40–50° C.; the ground space requirement is relatively great on account of the stay wires; in some countries it is difficult to aquire a building permit; this type of mast is disturbing from an aesthetical point of view.

Certain efforts have been made to replace the traditional lattice type mast by concrete towers, like before in combination with a separate container accomodating the electronic equipment. However, apart from the fact that these solutions do not eliminate the problems of the danger of sabotage and of the demand for air-conditioning plants, they give rise to considerably increased costs in addition to the fact that the very high weight of the tower in itself and the large surface exposed to wind give rise to further problems.

Swedish printed and published specification 333 959 discloses a so called turnstile antenna mounted on a concrete base. Although this prior art antenna is referred to as a tubular mast antenna it does in practice have a central, supporting stem serving as an antenna carrier and being surrounded by tube sections consisting of an insulating material, such as glass fibre material, serving as a weather protection. Thus, the tube sections do each only carry their own weight, whereas the central stem in the shape of tubes or rods constitute the actual supporting mast. The structure is complex and comparatively expensive and in addition thereto this antenna, which is intended for television broadcast, cannot replace the lattice type mast desribed in the introduction.

The basic object of the invention is therefore to provide a tower of the kind indicated in the introduction, which generally may replace the traditional lattice type masts and which eliminates the above discussed problems associated therewith.

According to the invention this object is achieved by means of a tower having the features indicated in the claims.

Preferred embodiments of the invention are indicated in the dependent claims.

Embodiments exemplifying the invention are more closely described below, with reference to the accompanying drawings, on which:

FIG. 2 illustrates a cross section through the first actual tower section of the tower according to FIG. 1, FIG. 3 illustrates a cross section through the bottom section of the tower according to FIG. 1, and FIG. 4 in a side-view illustrates an alternative embodiment of the tower according to the invention.

Figure 1:
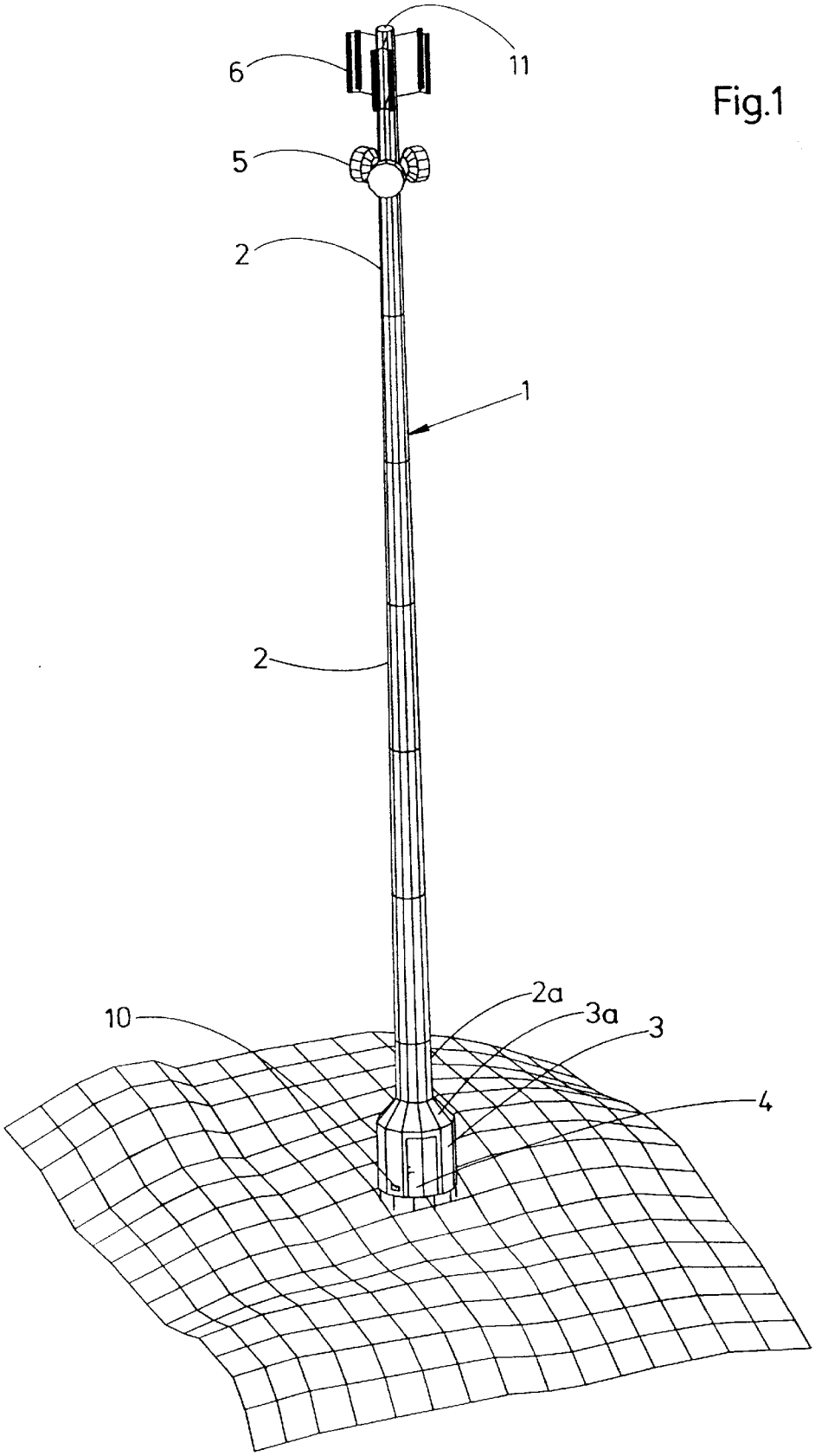
FIG. 1 is a perspective view of a first embodiment of the inventive tower.

With reference to FIGS. 1–3 it is clear that the tower 1 according to the invention basically is designed as a tower comprising a number of generally ring-shaped sections 2, 2*a,* 3, whereby an electronic equipment space is formed in the bottom section 3 which is widened in relation to the actual tower sections 2, 2*a*.

In the basic structure suggested in accordance with the invention the tower, sections 2, 2*a,* serving as an antenna carrier is integrated with the bottom section 3 serving as a space for for instance radio equipment RBS.

More specifically, the tower sections 2, 2*a,* of which the lowermost section 2*a* is illustrated in cross section in FIG. 2, consist of steel plate which in the illustrated example is bent to a 12-corner shape and welded together at the ends, not illustrated, for forming the generally ring-shaped sections 2, 2*a*. Furthermore, the sections are each provided with cross sections gradually diminishing towards their upper end, in the mounted condition, and, the sections are also provided with cross sections mutually diminishing towards the upper end of the tower, so that they may be assembled end to end, preferably by means of not illustrated bolt connections, for forming a tower having a generally slightly tapered shape.

The bottom section 3, which is illustrated in cross section in FIG. 3, likewise consists of steel plate which in the illustrated example is bent to a 12-corner shape and is welded together at the ends for forming the generally ring-shaped section 3. However, in contrast to the tower sections 2, 2*a* the bottom section 3 is not tapered but has substantially vertical side walls. As mentioned above the bottom section 3 is further designed having a cross section widened in relation to that of the first tower section 2*a* for providing the required space for radio equipment RBS, batteries B or the like.

With the electronic equipment space in the shape of the widened bottom section 3, integrated in the tower 1 according to the invention, a connecting section 3*a* is also required between the bottom section 3 and the lowermost tower section 2*a*. The connecting section 3*a* likewise consists of a ring-section 3*a* of steel plate bent to a 12-corner shape and welded together, which depending upon the difference in cross section between the bottom section 3 and the lowermost end of the tower section 2*a* is more or less tapered. The connecting section 3*a* is connected to the adjacent sections 3, 2*a* in a suitable manner, by welding or by means of bolts.

It is evident from FIG. 1 that the bottom section is provided with a door 4 for access to the electronic equipment space, and furthermore one of the tower sections, preferably the uppermost tower section 2, is provided with attachments, not shown in detail, for paraboloidal antennas 5 and other antennas 6. Cables to these antennas are drawn within the tower to the equipment RBS in the bottom section, whereby a very good protection against sabotage is achieved. Finally, the tower 1 is preferably provided with climbing ladders 7 and safety systems preventing operators from falling, not shown in FIG. 1 but indicated in FIG. 4.

In a practical example the sections 2, 2*a,* 3, 3*a* of the 12-corner tower illustrated in FIG. 1, consists of 9 mm high-strength steel type St 52-3 galvanized for corrosion resistance. For the bolt connections a bolt material SS-ISO 898/1, grade 8.8 has been used. The tower sections 2 have a standardized length of 6 meter, the first tower section 2*a* has a length of 3 meter and the bottom section 3, including the connecting section 3*a* has a length of 3 meter. With such a design the tower according to the invention may be built to a height of up to approximately 48 meter. The galvanized surface is well adapted for lacquering, for instance a combination of 2 layers of epoxy lacquer and one layer of polyurethane lacquer, whereby the tower 1 may be colour-matched to the surroundings to harmonize better with said surroundings. This provides an advantage from an aesthetical point of view.

Although the tower 1 according to the invention in FIG. 1 has been illustrated in a 12-corner design it is obvious that other polygonal shapes are possible for the sections 2, 2*a,* 3, 3*a,* as well as a design 1' illustrated in FIG. 4 where the sections 2', 2*a'*, 3', 3*a'* are shaped like trunkated cones, that is having circular cross sections. The embodiment illustrated in FIG. 4 also has a less widened bottom section 3' for the case where a smaller electronic equipment space is required.

A foundation, not shown, suitably consisting of concrete, is poured in situ and on the foundation the bottom section 3' is mounted by means of a crane. The tower sections 2', 2*a'*, which are preferably inter-connected two and two or three and three on the ground by means of bolts, are then lifted in position and are bolted to the earlier assembled sections.

According to a further development of the invention the tower 1 with its above described basic structure may, in a very advantageous manner, be employed for eliminating the demand for conventional air conditioning equipment. Due to the fact that the tower thorughout consists of the generally ring-shaped sections 2, 2*a,* 3, 3*a* a free passage for air is present from the bottom section 3 to the free end of the uppermost tower section 2, and by providing an intake air opening 10 (FIG. 1), preferably provided with a not specifically illustrated automatic or controlled intake air valve, in the bottom portion of the bottom section 3 and an exhaust air opening 11 (indicated in FIG. 1), likewise preferably provided with not illustrated automatic or controlled exhaust air valve and also a weather protection at the upper end of the uppermost tower section 2, cooling of the electronic equipment space is achieved according to the principle of natural ventilation. The air stream is thereby guided in a suitable, not specifically illustrated manner for efficiently cooling the required portions of the equipment RBS.

Depending upon the weather conditions at the location where the tower is erected, the natural ventilation may be supported by means of a not illustrated fan mounted in connection with the intake air or exhaust air opening 10 and 11 respectively. In cases where a more powerful cooling is required than what may be achieved by means of the surrounding air, the intake air may also, before being conducted to the equipment RBS, be conducted in loops around and/or under the foundation, which, if called for, may be digged down into the ground, so that the air is cooled by the lower temperature in the ground, so to speak by inverse ground-heating.

Having the above described structure the tower 1 according to the invention presents a great number of adavantages compared to the traditional masts, and of these advantages the following may be specifically mentioned:

- less ground space is required, in principle only corresponding to the area of the bottom section;
- building permit is more easy to obtain due to an aesthetically more attractive design;
- efficient in terms of energy consumption, in view of the fact that the elimination of the air condition plant lowers the electrical power requirement;
- better protection against sabotage by internal cable drawing;
- optional colouring to harmonize with the surroundings.

The objects of the invention have therefore been well achieved.

Although the invention has been described above with specific reference to specific embodiments thereof, it should be obvious that it also comprises alterations and modifications thereof which are obvious to a man skilled in the art. Therefore, the invention shall only be restricted by the enclosed patent claims.

What is claimed is:

1. A tower for carrying at least one antenna, comprising tubular tower sections having a generally ring-shaped cross section, which are mounted to each other in series, one on top of the other, wherein the tubular sections are adapted to receive cables connecting the at least one antenna with electronic equipment (RBS, R) associated with the at least one antenna; wherein at least one of the tubular sections is provided with attachments for the at least one antenna; one of the tubular sections is a bottom section comprising substantially vertical side walls and being adapted to accommodate the electronic equipment (RBS, B) and accessible from the outside; one of the tubular sections is a connecting section having a substantially frusto-conical shape and being provided between the bottom section and the lowermost one of the remaining tubular tower sections; and the remaining tubular sections have a cross section becoming gradually smaller towards an upper end and wherein each tubular tower section consists of a steel plate bent to the tubular shape.

2. The tower according to claim 1, comprising a free air passage extending from the bottom section to a free end of the uppermost tubular tower section, an intake air opening in a lower portion of the bottom section, and an exhaust air opening in connection with an upper end of the uppermost tubular tower section.

3. The tower according to claim 2, wherein the intake air opening comprises a controllable intake air valve and wherein the exhaust air opening is provided with a controlled exhaust air valve.

4. The tower according to claim 3, wherein said exhaust air opening comprises weather protection.

5. The tower according to claim 3, wherein said controlled exhaust air valve comprises automatic controls.

6. The tower according to claim 2, comprising a fan mounted in connection with at least one member selected from the group consisting of the intake air opening and the exhaust air opening.

7. The tower according to claim 2, wherein air sucked in through the intake air opening is conducted in a circuit comprising at least one member selected from the group consisting of loops around a foundation for the tower and loops under a foundation for the tower before being conducted to the bottom section.

8. The tower according to claim 1, wherein said tubular tower sections of the tower comprise high-strength galvanized steel plate, and wherein the lowermost one of the remaining tubular tower sections has a length of about 3 meter, and wherein the remaining tubular sections of the tower are of a standardized length of about 6 meter and wherein the bottom section, including the connecting section, has a length of about 3 meter.

9. The tower according to claim 1, wherein said steel plates comprise ends connected together so as to form said shape.

10. The apparatus comprising the tower according to claim 9, wherein said antenna carrying tower comprises a tapered cross-section.

11. The tower according to claim 10, wherein said antenna carrying tower comprises tubular tower sections having tapered cross sections tapering in a direction towards said top end.

12. The tower according to claim 1, wherein said antenna carrying tower comprises a tubular tower section having a top end.

* * * * *